US005361050A

United States Patent [19]

Einbinder

[11] Patent Number: 5,361,050

[45] Date of Patent: Nov. 1, 1994

[54] BALANCED SPLIT RING RESONATOR

[75] Inventor: Stephen B. Einbinder, Plantation, Fla.

[73] Assignee: Motorola, Inc., Schaumburg, Ill.

[21] Appl. No.: 85,810

[22] Filed: Jul. 6, 1993

[51] Int. Cl.[5] ..... H01P 1/203

[52] U.S. Cl. ..... 333/204; 333/26; 455/326

[58] Field of Search ..... 333/204, 205, 219, 246, 333/26; 455/285, 286, 324–327, 339

[56] References Cited

U.S. PATENT DOCUMENTS

| | | | |
|---|---|---|---|
| 3,992,674 | 11/1976 | Meyerhoff | 329/163 |
| 4,677,691 | 6/1987 | Scott | 455/326 X |
| 5,017,897 | 5/1991 | Ooi et al. | 333/204 |
| 5,045,815 | 9/1991 | Avanci et al. | 331/96 |
| 5,066,933 | 11/1991 | Komeda | 333/204 |

FOREIGN PATENT DOCUMENTS

| | | | |
|---|---|---|---|
| 0254506 | 11/1987 | Japan | 455/326 |

*Primary Examiner*—Seungsook Ham
*Attorney, Agent, or Firm*—Andrew S. Fuller

[57] ABSTRACT

A bandpass filter (40) includes a first microstrip split-ring resonator (12), having at least a first edge and a second edge, the first edge having a gap (20), and an input The bandpass filter (40) also includes a second microstrip split-ring resonator (14), having at least a first edge and a second edge, the first edge being coupled to the second edge of the first microstrip split-ring resonator electromagnetically (22) and by a central grounding aperture (223), and the second edge of the second microstrip split-ring resonator comprising a gap (26) and a balanced output (30, 32).

8 Claims, 3 Drawing Sheets

BALANCED SPLIT RING RESONATOR

TECHNICAL FIELD

This invention relates generally to split ring resonators and more specifically to using a split ring resonator as a filter and mixer combination.

BACKGROUND

Referring to FIG. 1, heterodyne receivers 100 combines, by "mixing," (216) a received high-frequency wave, such as a radio frequency wave (210), with a locally generated wave (218) in a nonlinear device (216) to produce sum and difference frequencies at the output of the mixer (216). Mixers for such a receiving circuit can also be used for frequency conversion in transmitters. Furthermore, the modulation process employed in a transmitter is applicable to the demodulation process of a demodulator circuit.

Nonlinearity is required in any mixer, for the production of frequencies not present in the input, but any nonlinear device can serve as a mixer. Thus, diodes, transistors, saturable reactors, or any other type of nonlinear devices can be used as a mixer.

Design choices depend upon considerations of mixer performance parameters, such as gain (or loss), noise figure, stability, dynamic range and possible generation of undesired frequency components that produce intermodulation and cross-modulation distortion. Conversion Gain (Loss) is the ratio of the output (IF) signal power to the (RF) input signal power. Contributing to the sensitivity of the receiver, noise figure is defined to be the signal-to-noise ratio SNR at the input (RF) port divided by the SNR at the output (IF) port. Isolation represents the amount of "leakage" or "feedthrough" between the mixer ports. Conversion Compression relates to the RF input power level above which the curve of IF output power versus RF input power deviates from linearity. Above this good linearity level, additional increases in RF input level do not result in proportional increases in output level. Two-Tone, Third-Order Intermodulation Distortion is the amount of third order or harmonic distortion caused by the presence of an unwanted received signal at the RF port. The higher the conversion compressions the greater will be the suppression of this intermodulation product.

One mixer used in heterodyne receivers, is the passive balanced mixer using a balanced bridge diode configuration, as seen in FIG. 2. Because such a balanced diode mixer produces both sums and differences of the two input frequencies, it can be used as amplitude modulators and demodulators as well as mixers. Hence the terms "balanced modulator" and "balanced mixer" are synonymous. In mixers, the input frequencies will be of the radio frequency signal $f_{RF}$ and of the local oscillator signal $f_{LO}$, resulting in the output frequency of the intermediate frequency signal $f_{IF}$. Similarly, in modulators, the input frequencies will be of the carrier signal fc and of the modulating signal fm, and the desired output frequency will be at fc±fm.

The passive balanced mixer of FIG. 2 is more specifically called a double-balanced mixer because it uses at least two nonlinear devices, such as diodes 51–54, with both the RF and LO inputs applied to separate ports 221–223 in a push-pull fashion so that neither signal appears at the other two ports. In other words, the LO signal (222) does not appear at, or is isolated from, the RF 221 or IF 223 ports, and so forth.

These four diodes 51–54 require a well-balanced input and output baluns 56 and 58 and accurate matching of the diode characteristics to provide a balanced output. Two wire-wound ferrite transformers 56 and 58 are typically used as the balun in ultrahigh frequencies (UHF). The trade-off for the high isolation provided is that this type of transformers is physically large as well as expensive. The degree of isolation between the three ports is achieved by how well these transformers are exactly center-tapped. It is assumed that the local oscillator voltage is large enough to control the on-off cycle of the diodes; that is, the currents due to $v_{RF}$ are small compared with those due to $v_{LO}$ such that the diodes act as switches.

The advantages of such a passive balanced mixer are that it has good linearity, port isolation, and can suppress even order spurious signals. However, this type of mixers has a high conversion loss of 6.5 dB at UHF frequencies. This high conversion loss results in a receiver that is not sensitive enough to meet the requirements of a low noise figure, low current specification.

Referring back to the receiver block diagram of FIG. 1, a bandpass filter 214, such as a microstrip split-ring resonator, is placed in front of the mixer 216 (and coupled by capacitors 215 and 217) to selectively attenuate the image spurious signal at $f_{im}=f_{LO}+f_{RF}$ and to remove all components except the desired one at $f_{IF}=-f_{LO}+f_{RF}$. As is known, a microstrip is a microwave transmission component in which a single conductor is supported above a ground plane while a stripline has two microstrips placed conductor-to-conductor with two ground planes on the exposed surfaces. Microstrip, strip-line ring resonators, and any other transmission line components are used in bandpass filter applications to overcome the influence that parasitic components generated at short circuited points in resonators have on circuit losses and resonance frequencies.

This microstrip split-ring bandpass filter typically has a loss of 2.5 db. Added to the 6.5 dB conversion loss of the balanced bridge diode mixer of FIG. 1, the combined loss of the two stages is 9.0 dB. This 9.0 dB loss is usually too high to allow the receiver to be sensitive enough without inserting an IF amplifier, adding in other components, or otherwise modifying the mixer, in a way, that may increase the mixer's intermodulation distortion. Thus, it would be advantageous to provide the functions of the passive balanced diode mixer and of the split-ring resonator filter but with less loss and sufficient attenuation at the image frequency.

SUMMARY OF THE INVENTION

Briefly, according to the invention, a filter, having an input port and an output port, includes first and second split-ring resonators. The first split-ring resonator is coupled to the input port of the filter, and the second split-ring resonator is coupled to the output port of the filter. The first split-ring resonator and second split-ring resonator are electromagnetically coupled together and also coupled to ground at a midpoint in their closest edges.

DETAILED DESCRIPTION OF THE PREFERRED EMBODIMENT

Figure 3:
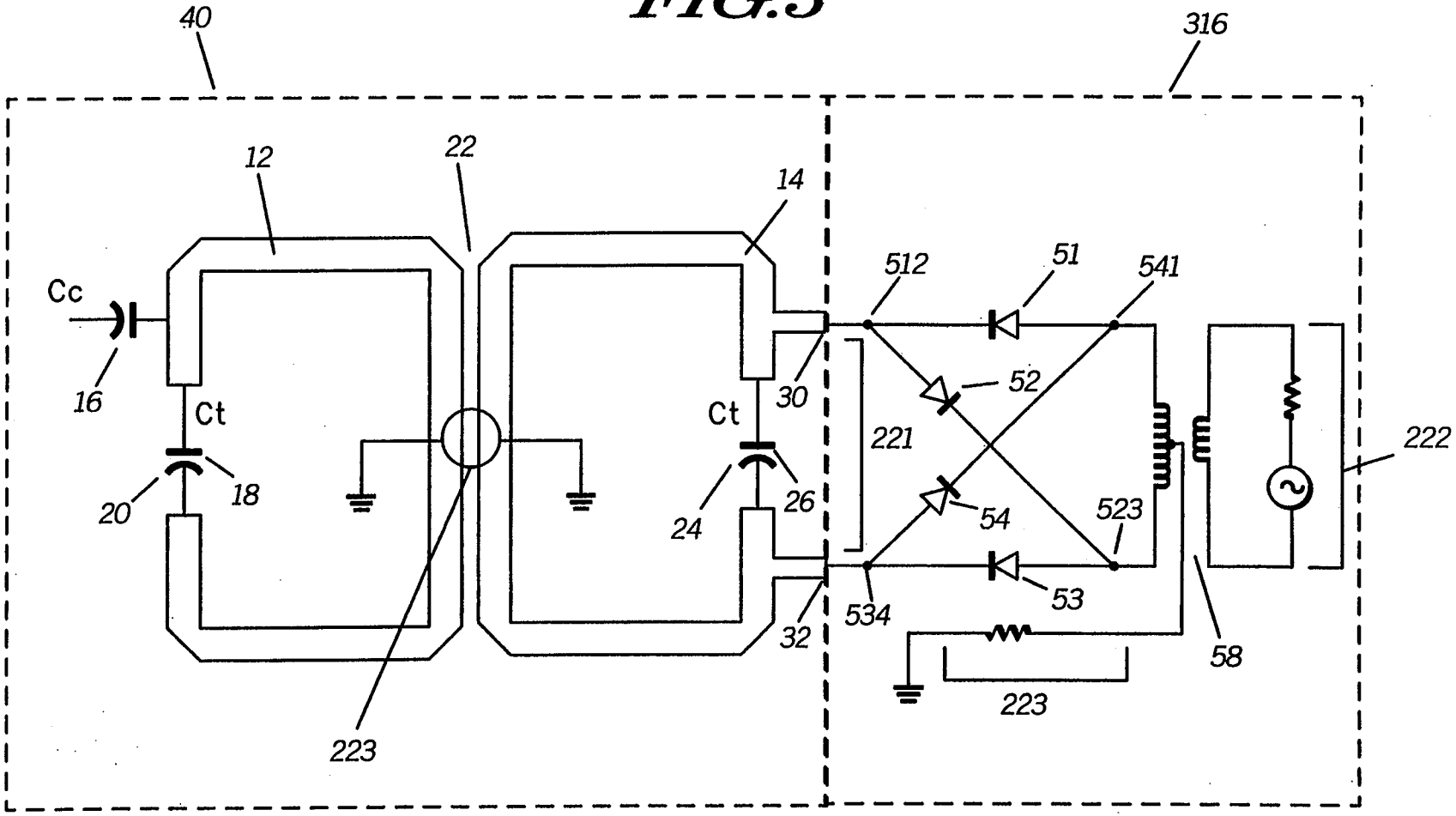
FIG. 3 shows a BPF having a single-ended input port, and a differential-ended output port and a mixer combination that is used in FIG. 1, in accordance with the present invention.

Referring to FIG. 3, a transmission line, such as a split-ring microstrip or stripline resonator bandpass filter (BPF) 40, in the form of a balanced ring filter, having a single-ended input port and a balanced (or differential) output port and a modified diode ring or bridge mixer 316, in accordance with the invention is shown. The BPF 40 comprises a first split-ring resonator 12, and a second split-ring resonator 14 to provide a frequency selective balanced output. The first and second split-ring resonators 12 and 14 each have a gap 20 and 26, respectively, therein.

Phase balance is mainly achieved by tapping the output terminals 30 and 32. Coupling energy out of the second resonator 14, from the first resonator 12, exploits the electrical properties of that structure to make phase balancing easier to accomplish. Due to the electro-magnetic coupling 22, and the length of the line, a single-ended to differential-ended BPF is achieved by choosing the locations of the first output terminal 30 and of the second output terminal 32 so that the second output terminal 32 is at a symmetric end in the opposite side of the gap 26 to achieve 180 degree phase difference.

This split-ring resonator filter can be laid out and fixed-tuned to a specific frequency by varying the physical parameters of the lines. To decrease the size of the resonators by shortening the length of the split-ring resonator 12 required to achieve resonance at a fixed-tuned desired frequency, a capacitor ($C_t$) 18 is connected across gap 20, and a capacitor ($C_t$) 24 is similarly connected across gap 26.

Figure 4:
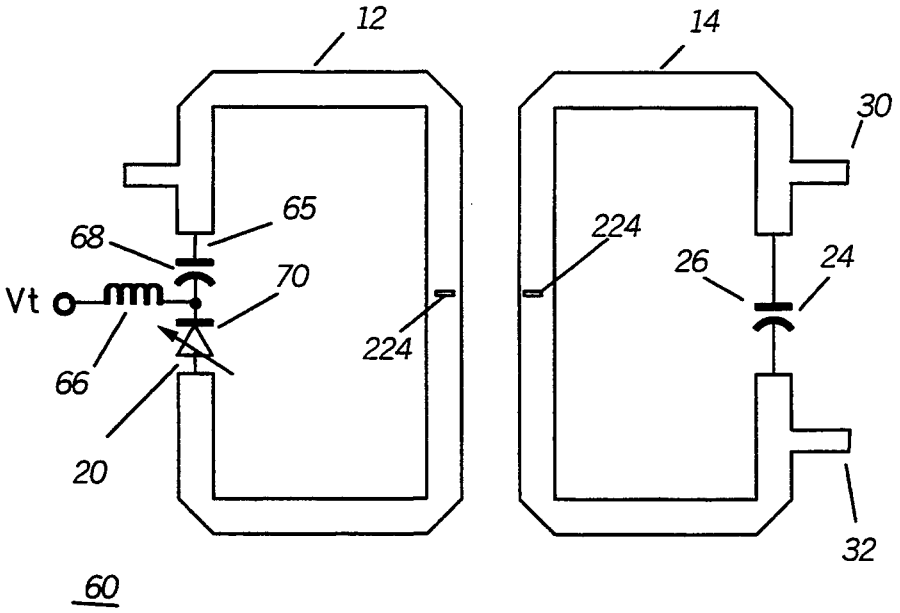
FIG. 4 shows an alternate tuned embodiment of the filter 40 of FIG. 3, in accordance with the present invention.

Alternately, a varactor can be used to tune the frequency response across the band of operation. The output or input tap positions, across the gaps, could be replaced with capacitors which could be trimmed to adjust the phase balance. Referring to FIG. 4, a selectively-tune balanced band-pass filter 60 is illustrated. The frequencies passed by the filter 60 is voltage-controlled. The split-ring resonator 12 has a varactor circuit, comprising a capacitor 68 and a varactor diode 70, connected across the gap 20 of the split-ring resonator 12. An inductor 66 is connected to the capacitor 68 and to the cathode of the varactor diode 70 to couple a control or bias voltage (Vt) to the varactor for controlling the filter response of the filter 60. For broader and better matching of the broad-band operation, the filter 40 of FIG. 3 may be further modified to also include a tuning network (such as the one connected across the gap 20) across the gap 26, in lieu of the capacitor 24).

There is at least one major difference between this present invention and any of the standard balanced ring filters, whether it has a single or differential ended, input or output. According to the invention, applicable to any ring filter or resonator, there is a ground connection means, such as a ground via at the center of the coupled lines which forces the center of the coupler to ground. This grounding aperture could be a through-hole, a slot, or any other means of coupling to the ground plane underneath, in one shared aperture 223 between the two resonators, as seen in FIG. 3 or one each, as in an independent ground 224, as seen in FIG. 4. Preferably, the grounding aperture is as large as practical, without being too large to create extra inductance. This grounding aperture, at the center of the two resonator edges, closest to each other, guarantees that the output voltages are nearly equal and opposite to achieve optimum phase balance. Thus, the frequency response of the inventive design with the hole results in better balance and cancelling at the image frequency.

Referring back to FIG. 3, a signal may be applied to the BPF 40, or a version of BPF 60 of FIG. 4, through a capacitor ($C_c$) 16. The signal is filtered by the BPF 40 and the resulting filtered signal is provided at the output terminals 30 and 32, thus providing a balanced output port.

Figure 1:
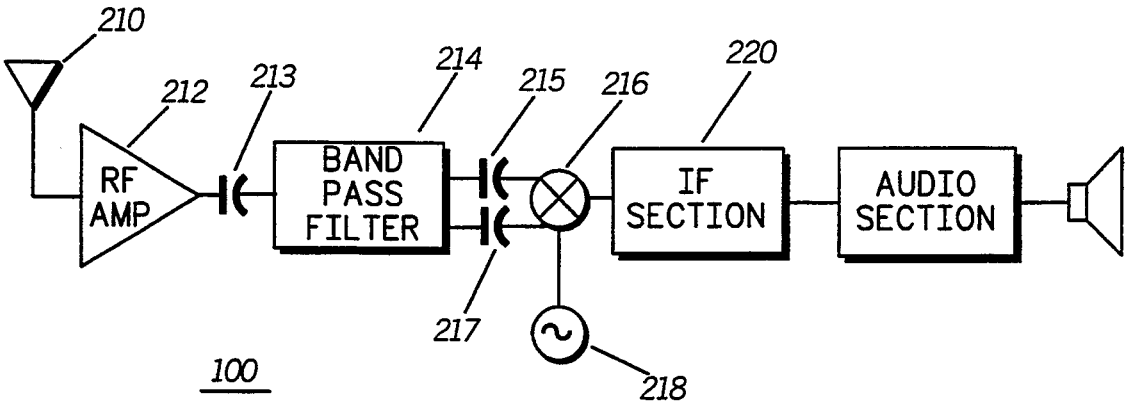
FIG.1 (PRIOR ART)
FIG. 1 shows a block diagram of a radio receiver.
Figure 2:
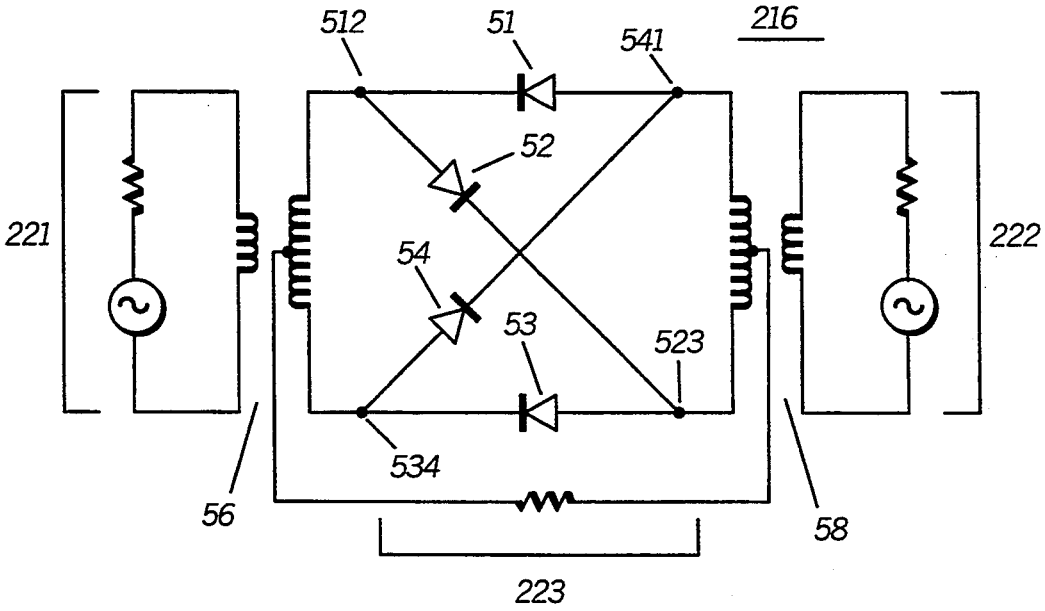
FIG.2 (PRIOR ART)
FIG. 2 shows a conventional passive balanced diode ring mixer that can be used in FIG. 1.

The balanced output port 30 and 32 of BPF 40 is directly coupled, without the intervening transformer 56 of FIG. 2, to a modified balanced diode bridge mixer 316 (i.e., a balanced input is required by the mixer) to provide a balanced mixer output. Because this design requires only one balun or transformer 58, without the coupling or matching capacitors 215 and 217 of FIG. 2, the modified mixer 316 results in significant size and cost savings. Using this grounded split-ring filter to provide mixing and filtering in a receiver will save 3 dB of insertion loss, one transformer, and two coupling or matching capacitors 215 and 217. Furthermore, when this balanced output of the modified ring filter 40 is used in conjunction with a modified bridge diode mixer 316, the total conversion loss of the two stages is about 6 dB in the frequencies of interest of the pass-band and the image attenuation is about 52 db at UHF.

Figure 5:
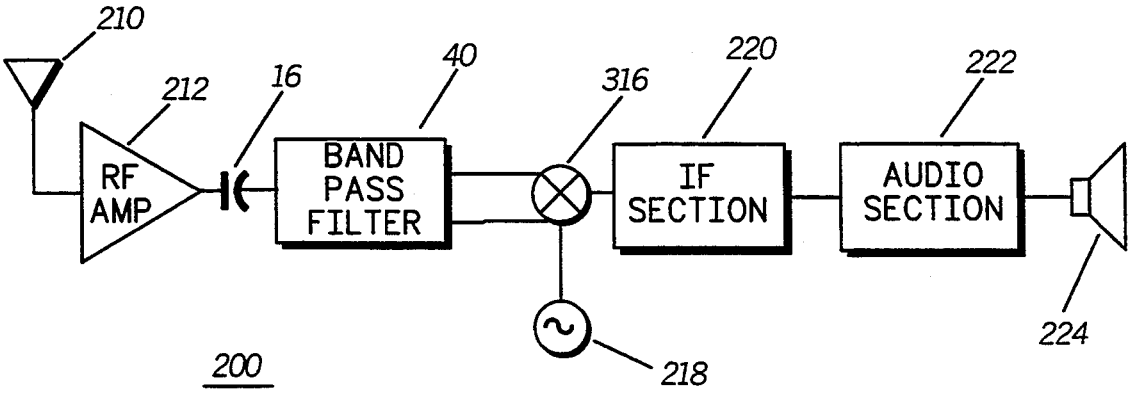
FIG. 5 shows a radio using the BPF and mixer of FIG. 3, in accordance with the present invention.

Substituting the filter and mixer combination of FIG. 3 into FIG. 5, a radio 200 is now shown incorporating the bandpass filter 40 and the single transformer bridge diode mixer 316, in accordance with the invention. A radio-frequency signal is received at a conventional antenna 210 and amplified by the RF amplifier 212 (an initial bandpass filter coupled from the antenna 210 to the amplifier 212 would also be advantageous). The BPF 40 in accordance with the invention is coupled from the amplifier 212 to the mixer 316 (through an optional impedance matching capacitor 16). The BPF 40 also has its balanced output port coupled to the balanced input port of the mixer 316. As with the input matching capacitor 16, output matching capacitors 215 and 217 may also be used or not used, depending on the transmission line characteristics.

One output is directly connected to two diode intersection points 512 and 534, half-way around the diode loop. Similarly, the output is directly connected to two other diode intersection points 541 and 523, half-way around the diode loop, in the other direction (this zigzag or "Z" configuration can also be re-drawn in the familiar ring or diamond shaped configuration). The signal is then mixed with a reference signal provided by a conventional local oscillator 218 to produce an intermediate frequency (IF) signal. The IF signal is then applied to a conventional IF section 220 where it is processed and demodulated to produce an audio signal. The audio signal is then applied to a conventional audio section 222 and presented to a listener by a conventional speaker 224.

This invention provides a method of obtaining all of the desirable qualities of the passive diode ring mixer but with 3 db less conversion loss. The net result of this invention is to provide the function of the filter and mixer component simultaneously with 6 dB of conversion loss and 50–55 db of attenuation at the Image frequency.

Employing the BPF 40 in such an application improves the performance of the radio 200. However, it will be appreciated that the invention may be advantageously used in other RF parts of radio receivers or transmitters.

What is claimed is:

1. A balanced output filter, comprising:

a first port;

a first transmission-line split-ring resonator, having at least a first edge and a second edge, the first edge having a gap therein, and the first edge being coupled to the first port;

a second transmission-line split-ring resonator, having at least a first edge and a second edge, the first edge being coupled to the second edge of the first split-ring resonator, and the second edge of the second split-ring resonator comprising a gap therein;

a second port coupled to the second edge of the second split-ring resonator, the second port having a balanced output, the second port comprising a first terminal located at one side of the gap in the second edge of the second split-ring resonator, and a second terminal symmetrically located at the other side of the gap in the second edge of the second split-ring resonator; and grounding means, electrically coupling the center of the first edge of the second split-ring resonator and the center of the second edge of the first split-ring resonator to ground, for improving the balanced output of the second port.

2. The filter of claim 1, wherein the grounding means comprises the center of the first edge of the second split-ring resonator and the center of the second edge of the first split-ring resonator sharing a common ground connection.

3. The filter of claim 1, wherein the grounding means comprises the first edge of the second transmission-line split-ring resonator having a first aperture near the center of the first edge and the second edge of the first transmission-line split-ring resonator having a second aperture near the first aperture.

4. The filter of claim 1, wherein the grounding means comprises the first edge of the second split-ring resonator having a first through-hole to an underlying ground plane, near the center of the first edge, and the second edge of the first transmission-line split-ring resonator having a second through-hole to the underlying ground plane, near the first through-hole.

5. A balanced output filter and mixer combination, comprising:

a first port;

a first microstrip split-ring resonator, having at least a first edge and a second edge, the first edge having a gap therein, and the first edge being coupled to the first port;

a second transmission-line split-ring resonator, having at least a first edge and a second edge, the first edge being coupled to the second edge of the first microstrip split-ring resonator, and the second edge of the second transmission-line split-ring resonator comprising a gap therein;

a second port having a balanced output, the second port being coupled to the second edge of the second transmission-line split-ring resonator, the second port comprising a first terminal located at one side of the gap in the second edge of the second transmission-line split-ring resonator, and a second terminal symmetrically located at the other side of the gap in the second edge of the second transmission-line split-ring resonator;

grounding means, electrically coupling the center of the first edge of the second transmission-line split-ring resonator and the center of the second edge of the first microstrip split-ring resonator to ground, for improving the balanced output of the second port; and a balanced four diode bridge mixer having a balanced input coupled to the first and second terminals.

6. The filter and mixer combination of claim 5, wherein the grounding means comprises the first edge of the second transmission-line split-ring resonator and the second edge of the first microstrip split-ring resonator having a common central ground aperture.

7. A communication device comprising:

receiver means for receiving radio-frequency signals;

a bandpass filter having a balanced output, coupled to the receiver means, comprising:

a first port;

a first transmission-line split-ring resonator, having at least a first edge and a second edge, the first edge having a gap therein, and the first edge being coupled to the first port;

a second microstrip split-ring resonator, having at least a first edge and a second edge, the first edge being coupled to the second edge of the first transmission-line split-ring resonator, and the second edge of the second microstrip split-ring resonator comprising a gap therein;

a second port having a balanced output, the second port being coupled to the second edge of the second microstrip split-ring resonator, the second port comprising a first terminal located at one side of the gap in the second edge of the second microstrip split-ring resonator, and a second terminal symmetrically located at the other side of the gap in the second edge of the second microstrip split-ring resonator; and grounding means, electrically coupling the center of the first edge of the second microstrip split-ring resonator and the center of the second edge of the first transmission-line split-ring resonator to ground, for improving the balanced output of the second port.

8. The communication device of claim 7 further comprising a balanced four diode bridge mixer having a balanced input coupled to the balanced output of the bandpass filter.

* * * * *